US006068455A

United States Patent [19]

Cowans

[11] Patent Number: 6,068,455

[45] Date of Patent: May 30, 2000

[54] LONG LIFE PUMP SYSTEM

[75] Inventor: Kenneth W. Cowans, Fullerton, Calif.

[73] Assignee: B/E Aerospace, Anaheim, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/821,399

[22] Filed: Mar. 20, 1997

[51] Int. Cl.[7] ..... F04B 39/06

[52] U.S. Cl. ..... 417/366; 417/357; 417/423.14; 417/373

[58] Field of Search ..... 417/357, 366, 417/423.12, 423.14, 423.15, 373

[56] References Cited

U.S. PATENT DOCUMENTS

| | | | |
|---|---|---|---|
| 3,192,861 | 7/1965 | Haegh | 417/357 |
| 5,403,154 | 4/1995 | Ide | 417/423.12 |
| 5,522,709 | 6/1996 | Rhoades | 62/50.6 |
| 5,525,039 | 6/1996 | Sieghartner | 417/32 |

OTHER PUBLICATIONS

Avallone & Baumeister III, Marks'Standard Handbook for Mechanical Engineers, p. 6–165, 1987.

*Primary Examiner*—Timothy S. Thorpe

*Assistant Examiner*—Cheryl J. Tyler

*Attorney, Agent, or Firm*—Jones, Tullar & Cooper, P.C.

[57] ABSTRACT

A system for pressurizing and pumping a fluid that may undergo substantial variations in temperature utilizes a motor with an enclosed rotor disposed adjacent and in driving relation to a centrifugal pump, but thermally isolated even though the fluid being pumped serves to establish hydrodynamic effects at large journal bearings supporting the rotor and the pump. The rotor is in magnetic interchange relation with an associated stator through a magnetic housing which, together with a pump mount coupling the motor to the pump, is fully encloses, apart from pump inlet and outlet apertures. The pump mount includes a low diameter neck portion about the shaft teat has low axial heat conductivity, thus providing an isolation spacing that also is filled with insulation material to eliminate significant convective heat transfer. Pressurized fluid at the pump is communicated into the motor enclosure only via small gaps, assuring that pressure conditions are maintained, but without affecting the internal motor temperature and the stability or life of the bearings, because of flow mass communication.

8 Claims, 3 Drawing Sheets

LONG LIFE PUMP SYSTEM

FIELD OF THE INVENTION

This invention relates to systems and devices for pressurizing and pumping fluid, and particularly to obtaining long life and reliability in compact versions of such systems and devices which are required to pump fluids which can vary widely in temperature.

BACKGROUND OF THE INVENTION

There is a general need for pressurizing and other pumping systems which can operate reliably without substantial maintenance for long periods of time. In the past, such systems have required stable environmental conditions, the use of special and relatively expensive components and units, or the employment of special configurations for enhancing the operating life of dynamic elements. Most such pumping systems use rotating components, because reciprocating pumps inherently have greater wear and somewhat greater complexity.

The bearings used in a rotating system are illustrative of the problem of balancing cost versus reliability. Large area journal bearings, for example, are extremely long life elements if a hydrodynamic effect is established and maintained using known relationships of rotational velocity, pressure and lubricating fluid viscosity. However, assuring maintenance of these conditions typically has required a source of pressurized lubricant that is itself adequately stable and protected against temperature variations. The pump must include compensation for any leakage of lubricating fluid that may occur. Ball or needle bearings can be used, but their greater costs do not insure greater reliability or longer life.

A rotating fluid pressurizer such as a turbine pump is itself a long-life component, unless it uses dynamic seals with load bearing surfaces. The nature and requirements of the associated system with which such a pump operates may, however, present special problems. In the semiconductor fabrication industry, for example, pumps are utilized to pressurize a heat transfer fluid that heats or cools, at different times, associated semiconductor fabrication tools. These tools are ordinarily configured in a "cluster", for close proximity during the different stages of semiconductor wafer fabrication. Each tool in the cluster is separately temperature controlled, and the temperature extremes may vary within a wide range such as −40° C. to +100° C. The space in a facility that can be devoted to the cooling system must be as limited as possible in view of the extremely high capital costs of semiconductor fabrication equipment.

Thus, some very stringent requirements must be met by the pumps which pressurize the heat transfer fluids used with different tools. The separate temperature control channels in which each pump is employed should be of small volume and low area "footprint". Within the volume, the pumps and their driving motors must be densely arrayed. Because the capital and operating costs of the fabrication tools are so high, pumping system down time is essentially intolerable, and stable long life operation (on the order of years) is needed. Because both hot and cold fluids must be pressurized by a unit, and within a small volume, the driving systems (motors) must either be designed or modified to accept the temperature extremes, which requires both added cost and space.

The fluid flow rate in temperature control units for cluster tools usually need not be high, although a substantial pressure differential must be maintained. A regenerative turbine pump of the type having a low "specific velocity" or speed is suitable for this purpose, since it is small and has only one moving component. It can also advantageously be used in other applications, where freedom from cavitation is required.

The heat transfer fluid used in modern systems, such as with the cluster tool application must itself have special properties in order to withstand the temperature extremes to be encountered while operating over a long time span. Glycol/water mixtures previously used are now being supplanted by perfluorinated compounds, which are non-toxic and have relatively stable viscosity characteristics while also having good heat transfer properties. The perfluorinated compounds, however, are sufficiently costly to require that systems using them be virtually totally free from leakage in long term usage.

SUMMARY OF THE INVENTION

A system in accordance with the invention utilizes the same heat transfer fluid that is being pressurized, whatever its temperature, as the lubricating fluid for large area journal bearings in a compact pump/motor combination. Adequate thermal isolation against conductive, convective and fluid temperature variations is provided between a motor and a coaxial turbine pump by a closed configuration that is open only at the pump ports.

To this end, the driving motor includes a rotor enclosed within a magnetic housing and rotating on a central shaft supported by at least one large surface area journal bearing in the housing. A stator outside the housing is in magnetic interchange relation with the rotor, while the interior of the housing is in limited fluid communication with the interior chamber of a turbine pump mounted on and driven by the shaft. The pump body is spaced apart from the motor housing by a small but adequate axial isolation gap or spacing. A pump mount between the motor and pump and having a relatively short length, low diameter neck portion of small cross-sectional area provides a low thermal conductivity path along the shaft axis. Thus, whatever the temperature level of the pump itself may be, there is no substantial conduction of thermal energy toward or away from the motor. The fluid communication between pump and motor interior is through a small pressure communicating path which does not permit significant flow. Thus, the interior of the enclosure is constantly and adequately pressurized, but effectively thermally isolated from temperature changes in the fluid. Also, the hydrodynamic bearing condition is maintained at all times in the journal bearings. Insulation material is disposed in the small diameter neck portion of the pump mount to serve as a barrier limiting convective heat transfer along the isolation spacing, parallel to the shaft. The three different thermal insulation measures assure that the motor temperature is essentially defined by motor operating parameters alone, whatever the heat transfer fluid temperature.

In consequence, the virtually closed structure encompassing the rotor, bearings, pump and pump mount insures stable and continuous operation because there is constant pressurizing of the bearings at stable temperature, and no points of wear or leakage. The fact that the pressurized fluid itself is used in creating the hydrodynamic effect assures that separate bearing lubricants are not needed.

In accordance with other features of the invention, the rotor within the motor enclosure is supported by journal bearings about the shaft at opposite ends, with the bearing closest to the pump being supported in the pump mount. The impeller for a regenerative turbine is mounted on an extended end of the shaft, within a pump chamber coupled to both inlet and outlet ports for the pump. Communication between the interior of the pump and the interior of the motor enclosure is via the space in the intermediate bearing. The facing surfaces of the motor housing, pump mount and pump, are sealed by O-rings. The isolation distance along the pump mount is chosen relative to the heat conductivity characteristics of the pump mount material and the cross-sectional area of the pump mount in the neck region so as to limit the wattage transferable axially to a small fraction of the wattage generated in the motor itself.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
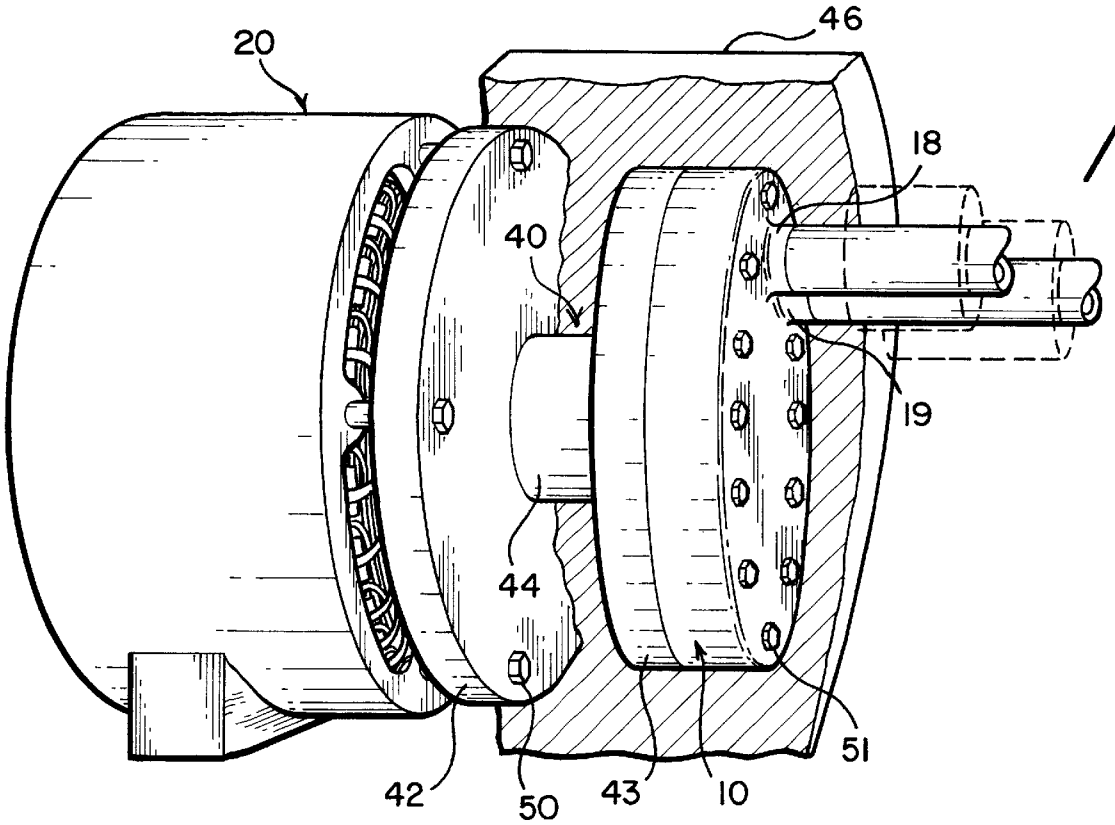
FIG. 1 is a perspective view, partially broken away, of a pump/motor combination in accordance with the invention.
Figure 2:
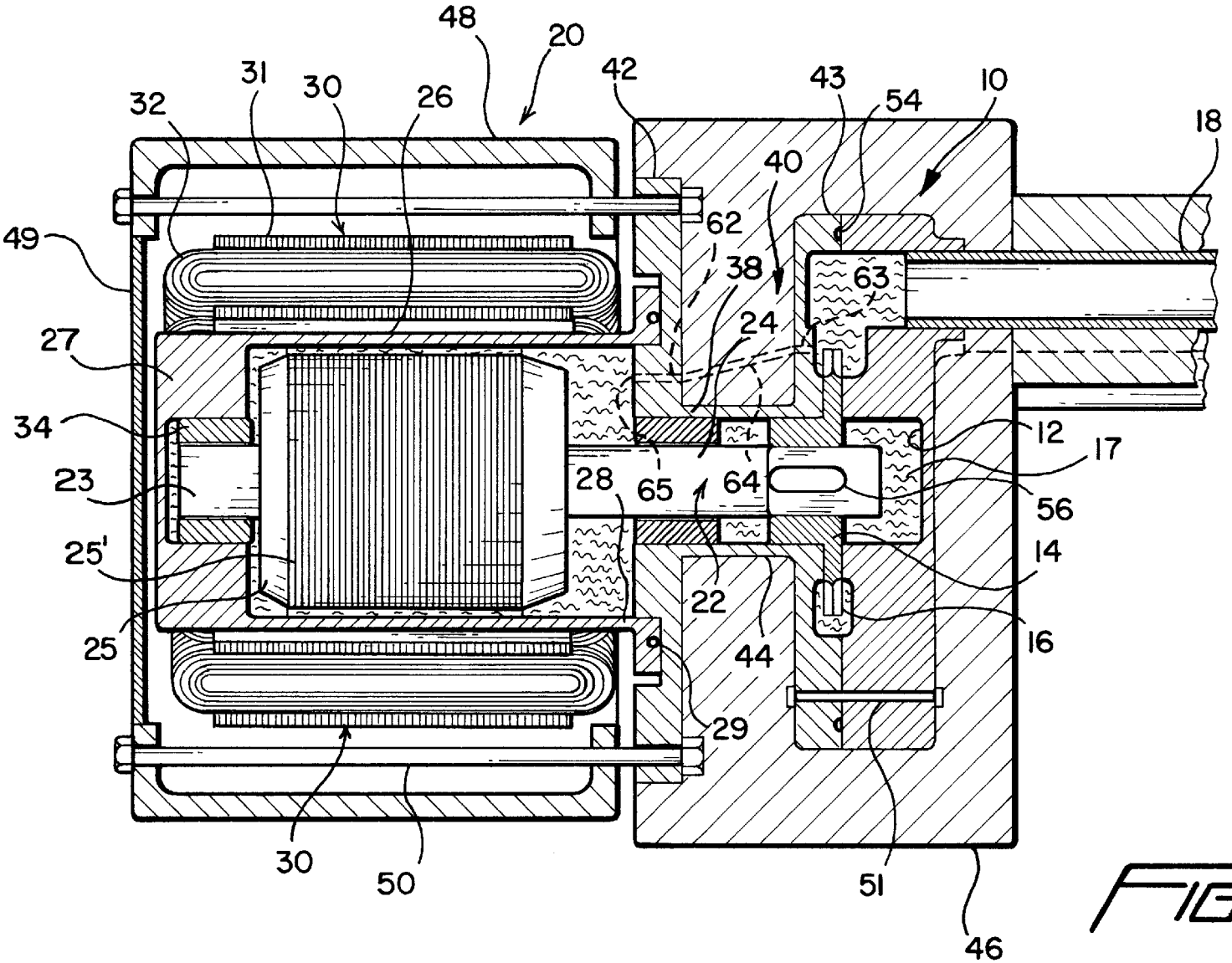
FIG. 2 is a side sectional view of the arrangement of FIG. 1.

A first example of a pump/motor combination in accordance with the invention is depicted in FIGS. 1 and 2, to which reference is now made. The pump 10 is of the regenerative turbine type, in which an internal chamber 12 encompasses an impeller disk 14 rotatable about a central shaft, the impeller disk 14 having peripheral paddles or blades 16 immersed in the heat transfer fluid 17 in the chamber 12. This type of pump is particularly suitable for maintaining pressure and adequate flow in a temperature control unit for a cluster tool in the semiconductor fabrication industry. It has low tendency to cavitate the fluid and low specific velocity because of its multiple small blades, and is particularly suited for use with perfluorinated compounds. These are preferred for many modern uses in the semiconductor fabrication industry because they are not only non-toxic but have high dielectric constant and very high resistivity and have the requisite compatibility with temperature variations. Here, it is assumed that the pressure range to be maintained is in the span of 2–20 psi, although this is dependent solely upon the application and pump design may be varied for higher or lower ranges, as desired. The flow rate is limited, being 1–10 gal/min for 200 mm wafer fabrication facilities but in the 5–10 gal/min range for 300 mm wafer facilities. In addition, the temperature range of the thermal transfer fluid is from −40° C. to +100° C. in this example. The pump 10 in FIGS. 1 and 2 has parallel inlet and outlet ports 18, 19, respectively, that are in communication with the internal chamber 12.

An electric motor 20 is spaced apart from the pump 10 along the central axis, and separated by an isolation gap or spacing described in greater detail hereafter. A central shaft 22 for the motor supports a rotor 25 having laminations 25', and has a first end 23 providing one rotor support, and a second extended end 24 which not only provides support but is a drive coupling to the impeller 14 in the pump 10. The rotor 25 on the central shaft 22 is enclosed within a magnetic housing 26 that includes a closed end 27 on the side opposite the pump 10. The housing also has a relatively open end 28 on the side facing the pump 10. Other geometries of housing can be used, such as multi-part units joined together. An O-ring 29 on the end face at the open end of the housing 26 provides a fluid-tight seal to an adjacent wall to which the motor 20 is to be attached.

The stator 30 outside and adjacent the housing 26 is in magnetic interchange relation with the rotor 25 through the wall of the housing 26. The stator 30 includes laminations 31 and windings 32 arranged in a conventional three-phase fashion to provide a rotating magnetic field for driving the rotor 25 and shaft 22 at substantially constant speed.

A first journal bearing 34 is mounted to support the first end 23 of the shaft 22 in the closed end 27 of the housing 26. The journal bearing 34 is a large area static bearing having low force loadings and serving as the base surface for a hydrodynamic bearing effect when the well-accepted minimal conditions of pressure, viscosity and rotational rate are maintained.

It is assumed that operation of the motor 20 will be essentially continuous, even though the motor may be stopped after extended intervals (e.g. a few hundred hours) to enable servicing of an associated tool in a semiconductor fabrication facility. Service of the pump/motor combination itself is not contemplated because its design provides extremely long life (estimated in the range of 10 years for the use indicated). When more frequent stops and starts are to be expected, or other conditions of intermittent operation might be encountered, the journal bearings, typically of metal, can be of carbon or incorporate carbon inserts.

The second extended end 24 of the central shaft 22 is supported by a second, large area, journal. bearing 38 that is adjacent the open end 28 of the magnetic housing, and positioned in an associated pump mount 40. A single journal bearing can be used if adequate in area to support the rotor mass within the length requirements of the system. The pump mount 40 also provides the physical intercoupling between the pump 10 body and the motor 20 housing. In this example the mount 40 is adequately strong to couple to the motor 20 at one end and cantilever the pump 10 and liquid mass at the other. The mount 40 includes a pair of spaced apart radial walls 42, 43 interjoined by a smaller diameter neck or sleeve 44 that is concentric with the central axis and the extended end 24 of the central shaft 22. The thermal conductivity of the neck 44 of the mount. 40 in the axial direction is low, because the neck portion 44 is configured to have a low cross-sectional area. Here the mount is of stainless steel and has an outer diameter of about 1.65 inches and a wall thickness of about 0.30 inches to provide adequately low axial thermal conduction. Stainless steel has a thermal conductivity of about 0.2 watt/°C. cm so that the thermal loss along the axial length of the mount 40 is approximately 30 watts transmitted in one inch of length with the cross-sectional area established by these dimensions. The critical distance or isolation spacing along the neck portion 44, for the given widely varying temperatures at the pump 10 relative to the motor 20, need only be approximately 1½ inches to prevent heating of the motor interior. The motor 20, of course, must dissipate its own internal energy, caused by resistive, inductive and frictional losses, but with this arrangement, conductive heat transfer from or to the varying temperature pump is a negligible factor at the motor.

The pump 10 also, of course, appears appears as a spaced apart hot or cold source relative to the more constant temperature motor 20. The interposition of insulation 46, typically conventional foam material, about the neck 44 region, between the radial walls 42, 43 of the pump mount and encompassing the outside of the pump mount 40 and the pump 10, effectively shields against any meaningful convective heat transfer.

At the motor 20, the stator 30 is surrounded by an outer cylindrical housing 48 including a back wall 49 substantially transverse to the central axis. A fan (not shown) will usually be used for ambient cooling, and may be spaced apart or positioned as part of the back wall. Coupling bolts 50 between one radial wall 42 of the pump mount 40 and the outer housing 48 secure the pump mount 40 to the motor 20. Coupling bolts 51 between the second radial wall 43 and the pump 10 body provide cantilever support for the pump, fittings and fluid. An O-ring 54 between the facing broad surfaces of the second radial wall 43 and the pump 10 assures a hermetic seal, so that the only openings in the enclosed pump/motor system are the inlet and outlet. The central shaft 22 includes, at its second extended end 24, an internal keyway 56 in the region encompassed by the pump impeller disk 14, so that a key or set screw (not shown in FIG. 2) may secure the impeller 14 to the shaft 22 to ensure that there is no relative circumferential displacement.

Figure 4:
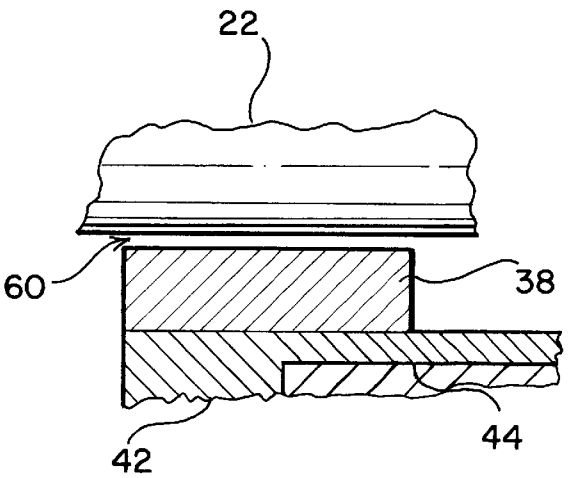
FIG. 3 is a perspective view of a different configuration of motor pump mount and pump in a combination in accordance with the invention and FIG. 4 is a an enlarged sectional side view of a portion of the pump/motor combination of the present invention.
Figure 3:
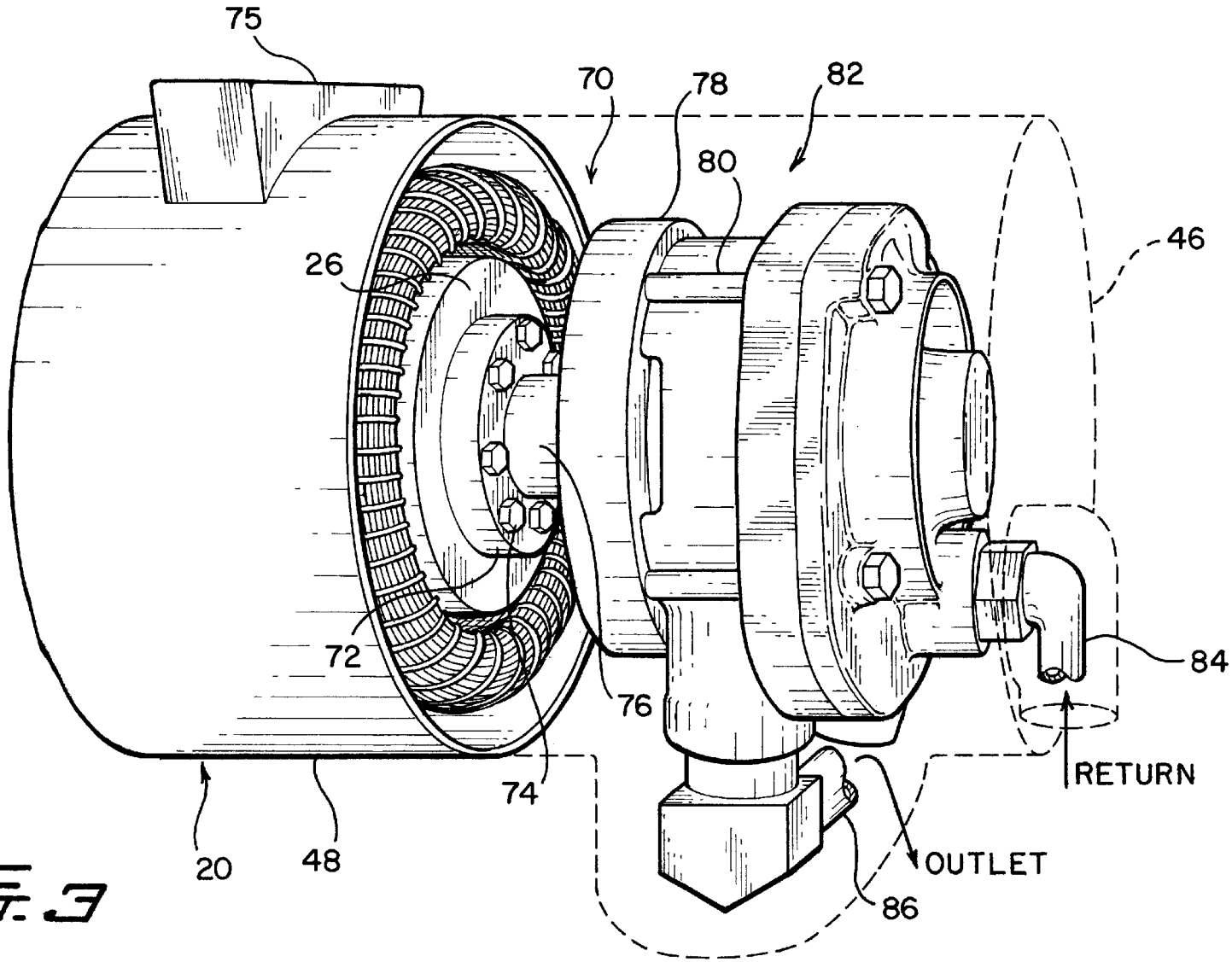

Fluid communication is establisher between the pressurized internal chamber 12 of the pump 10 and the interior of the housing 26 about the rotor 25, via the spacing 60 between the journal bearings 34, 38 and the shaft 22, as seen in FIG. 4. If more fluid access is needed, a pair of aligned small capillary channels 62, 63 (as shown in dotted lines) can be provided in the radial walls 42, 43 of the pump mount 40, and interconnected by a small conduit 64 close to the neck 44 as depicted in FIG. 3. If such a conduit is used, it can incorporate filter material 65, such as multiple interlinked fibers, to block passage of particulates, especially metal particulates, into the bearing region.

The small radial gaps 60 occupied by fluid at the bearings 34, 38 allow transfer of pressure from the pump 10 into the enclosed volume containing the hydrodynamic bearings, as well as the passage of any needed replenishment flow into the motor housing 26. From the thermal standpoint, however, the enclosed fluid is essentially stagnant and the hotter or colder fluid being pressurized at one end is equalized to about the motor temperature before entry. Consequently, the thermal energy level in the fluid 17 is isolated from penetrating into the region of the journal bearings 34, 38, which are kept in a relatively narrow temperature range to assure long life. If desired, a non-load bearing seal (not shown) adjacent the impeller 14 on the motor side will also restrict flow without complete blockage. Thus, the interior pressure is held high enough for the hydrodynamic bearing effect to be maintained at all times of operation. With a rotational velocity at the motor 20 of 3450 rpm, a pressure of 10–25 psi, and a fluid viscosity in the range of 1 to 50 centipoise, the needed hydrodynamic support is also constant. The parameters can, of course, be varied for different applications.

This system accordingly meets all of the stringent requirements that heretofore have militated against achieving low cost, compact pump systems which pressurize and/or pump fluids varying within extremely wide temperature ranges. Since the housing 26 for the rotor 25 is constantly filled with the same fluid 17 as is constantly being pumped, and that fluid is maintained at substantially constant temperature as well as pressure, the bearings have no meaningful wear. The closed system blocks leakage of expensive fluids and need for any maintenance or service operations for very long intervals.

Constant pressurization, without impulses, and without cavitation, is a highly desirable objective for some pump systems and fluids, independent of the purpose for which the fluid is used. When it is desirable to avoid pressure discontinuities that can be caused by cavitation (as in a gear pump), or merely bubbles or cavitation in the fluid itself, the characteristics of an individual pump become of importance. In this respect, the numerous small peripheral blades or paddles on the impeller in a regenerative turbine offer superior characteristics, because individually they do not displace large fluid masses or create substantial disruption. The condition for the onset of cavitation is given by:

$$Pm > Pv \qquad \text{(Equation 1)}$$

where Pm is the minimum pressure at any point on the surface of a moving body and Pv is the vapor pressure of the liquid at the prevailing temperature. Determination of Pm can be approached mathematically in terms of Bernoulli's equation, relating pressures to velocities and density, giving the condition for avoidance of cavitation as:

$$\frac{Pa + Ps - Pv}{(P/2)V^2} > \left[\left(\frac{v}{V}\right)^2 - 1\right] \qquad \text{(Equation 2)}$$

where Pa is the pressure on the free surface, Ps is the hydrostatic pressure at an undisturbed point, V is the absolute velocity, and v is the velocity of undisturbed flow. The entire term is usually denoted by σ which is called the cavitation number. The magnitude of the term on the right of the inequality sign can only be calculated for relatively simple bodies, such as sphers, and must be obtained by experiment. Workers in the art have devised useful equations for different situations, such as flow in pipes and marine propellers. For pumps, a useful empirical expression has been found to be:

$$\sigma_\gamma = \frac{H_{sv}}{H} > (\sigma_\gamma)_c \qquad \text{(Equation 3)}$$

where $H_{sv}$ is the net positive section head at the pump inlet, and H is the total head under which the turbine operates. The value of $(\sigma_\gamma)_c$ is a fixed number, found empirically, for a given design. The regenerative turbine pump has a high cavitation number, and therefore a low tendency, at a relatively high pressure, to induce bubbles or cavitation.

This is an important consideration, along with the capability of the present system for long term use, in applications in which a substantial pressure head must be maintained without affecting the characteristics of the fluid being pressurized, whether because of fragility (as with biological fluids) or because of pressure variations.

A different configuration of pump mount 70 can be used in a different type of pump is used, as shown in FIG. 3. Here, the pump mount has a smaller radius disk or wall 72 that is coupled to the magnetic enclosure 26 for the rotor in the motor 20, by bolts 74. The outer housing 48 for the motor 20 is attached to the back plate or fan (not shown in FIG. 3) which couples to the rotor housing 26. The entire assembly can be supported by a bracket 75 coupled to the top of the housing 48, to suspend the assembly from an upper surface.

In the pump mount 70, a narrow neck portion 76 extends to a radial wall 78 coupled by bolts 80 to a pump 82, which is again of the regenerative turbine type. In this design, available commercially from different sources, the return line 84 couples into a broad face of the pump and output moves through a tangential path to an outlet line 86. Again, the pump and pump mount may be encompassed in insulation 46 to block convective heat transfer in the isolation spacing between the radial wall 78 and the motor 20.

In both the example of FIGS. 1 and 2 and the example of FIG. 3, O-rings are used in a conventional manner to assure leak-free facings between the planar walls of the motor and pump relative to the pump mount. Within the system, thrust bearings and dynamic seals (not shown) can be incorporated for their properties without diminishing the lifespan of the unit, since such elements are used in a non-load bearing fashion.

Although there have been described above, and illustrated in the drawings, various forms and expedients in accordance with the invention, it will be understood that the invention is not limited thereto but encompasses all expedients and alternatives within the scope of the appended claims.

What is claimed is:

1. A fluid pumping device comprising:

a motor assembly including a rot or and a central shaft, said central shaft having an extended first end, and a second end, said rotor being supported by said central shaft intermediate said first and second ends of said central shaft;

a fluid filled motor housing, said central shaft and said rotor being s supported for rotation within said fluid filled motor housing, said extended first end of said central shaft extending out of said fluid filled motor housing;

at least one large surface area hydrodynamic journal bearing supporting said central shaft, said large surface area hydrodyamic journal bearing being located intermediate said rotor and said extended first end of said central shaft and providing small radial, fluid receiving gaps between said large surface area hydrodynamic journal bearing and said central shaft;

a rotatable pump impeller supported for rotation in a pump housing, said pump impeller being attached to said extended first end of said central shaft, said pump housing receiving a fluid to be pumped, the fluid to be pumped by said pump impeller in said pump ho using being subject to temperature variations;

limited fluid access between said fluid filled motor housing and said pump housing, the fluid in said fluid filled motor housing being substantially thermally stagnant and isolated from the fluid in said pump housing by said limited fluid access between said fluid filled motor housing and said pump housing, said limited fluid access restricting flow of the fluid into said fluid filled motor housing to pressurizing and replenishment fluid flow such that the fluid temperature about said rotor and said large surface area hydrodynamic journal bearing is substantially constant at an ambient temperature; and a pump mount intercoupling and spacing apart said pump housing and said fluid filled motor housing by an isolation gap, said pump mount including a sleeve having a low cross-sectional area and low thermal conductivity, said low cross-sectional area and low thermal conductivity sleeve extending between, and thermally separating said fluid filled motor housing and said pump housing, said low cross-sectional area and low thermal conductivity sleeve forming a low thermal conductivity path between said pump housing and said motor housing, said isolation gap spacing said pump housing and said fluid filled motor housing to prevent convective heat transfer between said pump housing and said fluid filled motor housing, said motor assembly rotor and the fluid in said fluid filled motor housing being thermally isolated from the fluid in said pump housing by said limited fluid access between said fluid filled motor housing and said pump housing, by said low cross-sectional area and low thermal conductivity sleeve and by said isolation gap preventing convective heat transfer between said fluid filled motor housing and said pump housing, the fluid in said fluid filled motor housing and said motor assembly rotor remaining thermally isolated from temperature changes in the fluid to be pumped by said pump impeller.

2. The fluid pumping device of claim 1 wherein the fluid is a perfluorinated compound, wherein the fluid is a liquid ranging in temperature from about −40° C. to about +100° C., and wherein said low thermal conductivity sleeve and said limited fluid access limit heat conduction to and away from the pump to wattage levels such that the liquid temperature in said motor assembly is determined essentially by motor parameters alone and the pressure and viscosity conditions needed for hydrodynamic support of said central shaft at said bearing is maintained.

3. The fluid pumping device of claim 1 wherein said sleeve is of stainless steel, and wherein said limited fluid access between the pump and the rotor includes a capillary flow path extending between said fluid filled motor housing and said pump housing.

4. The fluid pumping device of claim 1 wherein said sleeve has an outer diameter of about 1.65", a wall thickness of about 0.30", and a length of about 1.5", and wherein the fluid pumping device maintains hydrodynamic bearing operation at about 3450 rpm by maintaining pressure at about 10–25 psi and viscosity in the range of 1–50 centipoise.

5. The fluid pumping device of claim 1 further including insulation placed between said motor housing and said pump housing.

6. The fluid pumping device of claim 1 further including a second large area hydrodynamic journal bearing supporting said second end of said central shaft.

7. The fluid pumping device of claim 1 further including a fluid flow conduit extending between said motor housing and said pump housing, said limited fluid access including said fluid flow conduit.

8. The fluid pumping device of claim 1 wherein said rotatable pump impeller includes a hub secured to said extended first end of said central shaft and a disk terminating in pump blades.

* * * * *